US005888100A

United States Patent [19]

Bofill et al.

[11] Patent Number: 5,888,100

[45] Date of Patent: Mar. 30, 1999

[54] TWISTED PAIR CABLE AND CONNECTOR ASSEMBLY

[75] Inventors: Pedro Durán Bofill; Ignacio Freire Venegas, both of Barcelona, Spain

[73] Assignee: The Whitaker Corporation, Wilmington, Del.

[21] Appl. No.: 799,974

[22] Filed: Feb. 14, 1997

[30] Foreign Application Priority Data

Feb. 22, 1996 [GB] United Kingdom ..... 9603751

[51] Int. Cl.[6] ..... H01R 23/02

[52] U.S. Cl. ..... 439/676; 439/344; 439/460; 439/941

[58] Field of Search ..... 439/676, 418, 439/425, 344, 460, 941

[56] References Cited

U.S. PATENT DOCUMENTS

| | | | |
|---|---|---|---|
| 4,516,822 | 5/1985 | Wolfel | 339/103 M |
| 4,601,530 | 7/1986 | Coldren et al. | 339/103 M |
| 4,767,355 | 8/1988 | Phillipson | 439/425 |
| 4,781,623 | 11/1988 | Philippson et al. | 439/676 |
| 4,978,316 | 12/1990 | Yahata | 439/449 |
| 5,350,324 | 9/1994 | Guilbert | 439/941 |
| 5,505,638 | 4/1996 | Su et al. | 439/676 |
| 5,624,274 | 4/1997 | Lin | 439/676 |

*Primary Examiner*—Neil Abrams
*Assistant Examiner*—Brian J. Biggi

[57] ABSTRACT

A modular plug connector and cable assembly comprises a modular plug with a wire holder, and a twisted pair cable. The twisted pairs are braided in order to cross over conductors of the twisted pairs, and furthermore to separate the pairs of conductors and from and in order to reduce inductive and capacitive coupling therebetween. The wire holder helps to keep the pairs twisted and the straightened end portions of the conductors as short as possible. The cable assembly as described provides low cross talk and enables consistent termination with little deviation in the signal transmission speeds.

10 Claims, 6 Drawing Sheets

Fig. 3
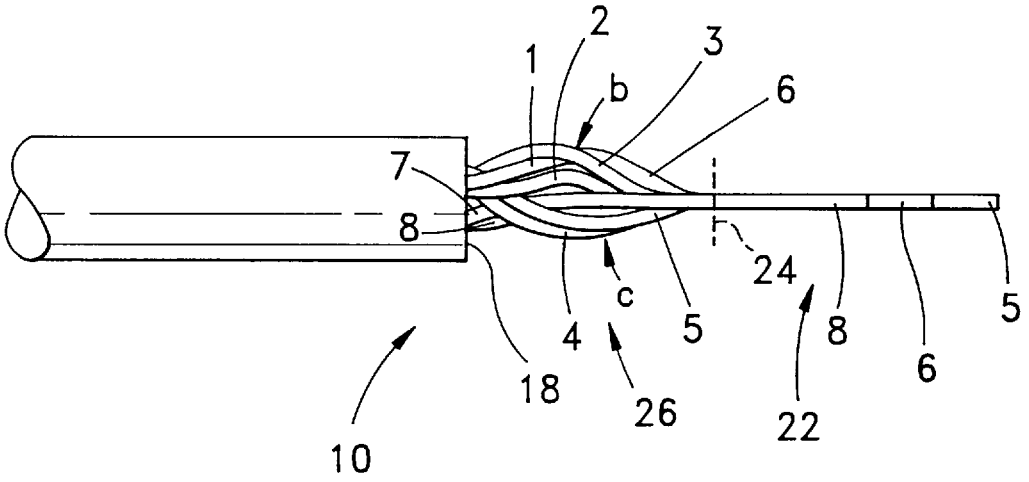
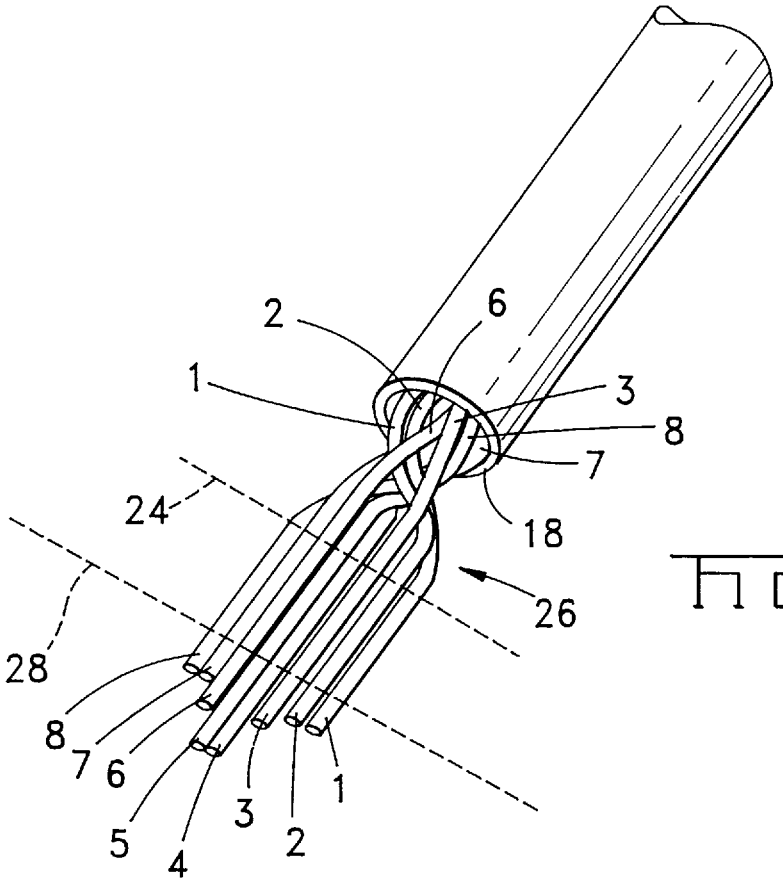
Fig. 4

TWISTED PAIR CABLE AND CONNECTOR ASSEMBLY

BACKGROUND OF THE INVENTION

1. Field of the Invention

This invention relates to a cable assembly comprising a connector terminated to a cable having pairs of twisted conductors, the assembly terminated in such a way as to reduce electromagnetic cross-talk for high speed signal transmission.

2. Description of the Prior Art

There is an increase in demand for cable and connection systems to transmit digital signals at high speeds. As frequency increases, emission of electromagnetic and electrostatic "noise" increases. This is a particular problem for closely positioned conductors, due to electromagnetic interference between the conductors, which is often called "cross-talk". Beyond a certain transmission frequency, cross-talk becomes unacceptably intense (i.e. the signal to noise ratio decreases to an unacceptable level), thus limiting the speed of signal transmission. In cables, one of the way of reducing cross-talk is by twisting pairs of conductors, where one conductor of the pair is for transmitting a positive signal, and the other conductor for transmitting a negative signal of equal intensity and timing as the positive signal. This is called a differential pair due to the nature of the opposed signals in the pair. Due to the twisting about each other, magnetic and electrical field signals emitted from each of the conductors cancel each other out. Similarly, external electromagnetic noise received in the pair cancel each other out. Cross-talk effects are thus reduced in a simple and cost effective manner. Such pairs can thus be placed within a cable and positioned close together whilst nevertheless transmitting high speed electrical signals.

One of the problems however occurs at the connection end, where the conductors are connected to terminal within a connector. Terminals of connectors are often positioned in juxtaposed parallel relationships, thereby causing "untwisting" of the conductor pairs. Cross-talk is thus increased at the connector.

One way of reducing cross-talk effects is shown in European Patent Publication No. 583111 where conductor pairs of a connector are crossed over, thus behaving in a similar manner to that of a twisted cable. Crossing over of contacts in connectors is also shown in U.S. Pat. No. 5,186,647. The latter shows cross-talk reduction in a modular jack, which is a standardized connector widely used in telecommunications and computer data interconnection systems. Standardized modular jacks and corresponding plugs for connection thereto, were initially designed and used for low speed data transmission systems, and are thus not necessarily the most effective connection systems for use with high speed data transmission. Due to their widespread use however, there is a need to improve the data transmission speed capabilities of modular plug and jack connectors whilst respecting the standardized interface requirements.

Another means of reducing cross-talk is by judicious capacitive or inductive coupling between conductors of a connector. Untwisted conductors that are connected to a connector, for example a modular plug, may still pose a problem. Firstly, compensation for cross-talk in a connector is not as good as not being subject to the cross-talk in the first place (for example by maintaining the twist in the wires). Secondly, the length of the exposed and untwisted wire ends that are connected to a connector is often not accurately prepared therefore decreasing the reliability of cross-talk compensation in the connector. For example, cable assemblies may be prepared under field conditions by human operators with varying degrees of skill. The accuracy of conductor end lengths and quality of termination is therefore difficult to guarantee within a tight specification.

It is a continuous requirement to reduce connector assemblies as cost effectively as possible, whilst nevertheless increasing reliability and furthermore increasing the possible speed of signal transmission. It is also desirable to have cable and connector assemblies for high speed signal transmission that interface with or use common industry standards. A good example of the latter is the use of modular plugs and jacks, and cables with pairs of twisted conductors.

SUMMARY OF THE INVENTION

It is therefore an object of this invention to provide a cost effective connector and cable assembly for high speed signal transmission.

It would be advantageous to provide a connector and cable assembly having twisted pair conductors that ensures reliable termination and high speed signal transmission.

It would be advantageous to provide a cable and connector assembly for twisted pair conductors, that can be terminated in a reliable manner in the field by a human operator, or otherwise, whilst ensuring high speed signal transmission.

It is an object of this invention to provide a cable and connector assembly for high speed signal transmission that uses common industry standards, in particular for twisted pair cable and modular plug or jack connectors.

Objects of this invention have been achieved by providing a connector and cable assembly comprising a cable having pairs of insulated conductors twisted together, for termination with contacts of a connector of the assembly in a particular order, the cable having an outer jacket surrounding the pairs of conductors, an end portion of the cable outer jacket being removed to expose end regions of the conductors, wherein at the exit from the cable jacket, twisted conductor pairs are crossed over each other in a braid fashion such that at least one conductor of a first pair is spatially separated from at least one conductor of a second pair, by at least one conductor of a third pair. The latter spatially separates conductor of the first and second pairs to limit the cross-talk effects therebetween. The braiding not only ensures spacial separation of conductors that are most influenced by cross-talk, but also ensures that the length of the untwisted and straightened end regions of the conductors for termination to the connector is as short as possible. The braiding also maintains the twist in the conductor pairs in a reliable manner as close to the end of the conductors as possible.

Provision of a connector with a wire holder or manager that is separately inserted over the wire ends to arrange and hold them in place advantageously combines with the braid and/or twist to have the shortest possible straightened portion of conductor ends. In particular, the wire manager can be drawn tightly against the twist of the conductors, and surplus length of conductor ends projecting beyond the wire manager front end, can be trimmed off. The wire manager or holder can then be inserted into a connector, in this embodiment a modular plug, to present the straightened wire ends below the connector contacts for termination thereto. Other aspects of the invention are further described in the claims.

Further advantageous features of the invention will be apparent from the description, drawings and claims.

BRIEF DESCRIPTION OF THE DRAWINGS

FIG. 1*a* shows the twisted pairs exposed in an end region from the cable outer jacket, and FIG. 1*b* shows a widely used arrangement of the conductors untwisted and straightened for connection to a connector;

FIG. 3 is a view in the direction of arrow 3 of FIG. 2*e;*

FIG. 4 is an isometric view of the cable of FIG. 3;

DETAILED DESCRIPTION OF THE PREFERRED EMBODIMENT

Figure 1A:
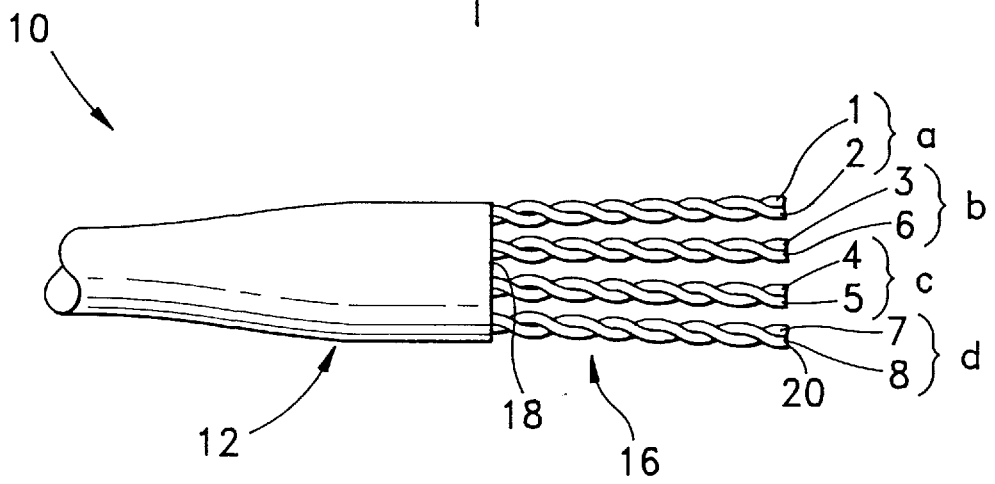
(PRIOR ART) Fig. 1a
FIGS. 1*a* and 1*b* are plan views of a typical four twisted pair cable where
Figure 5:
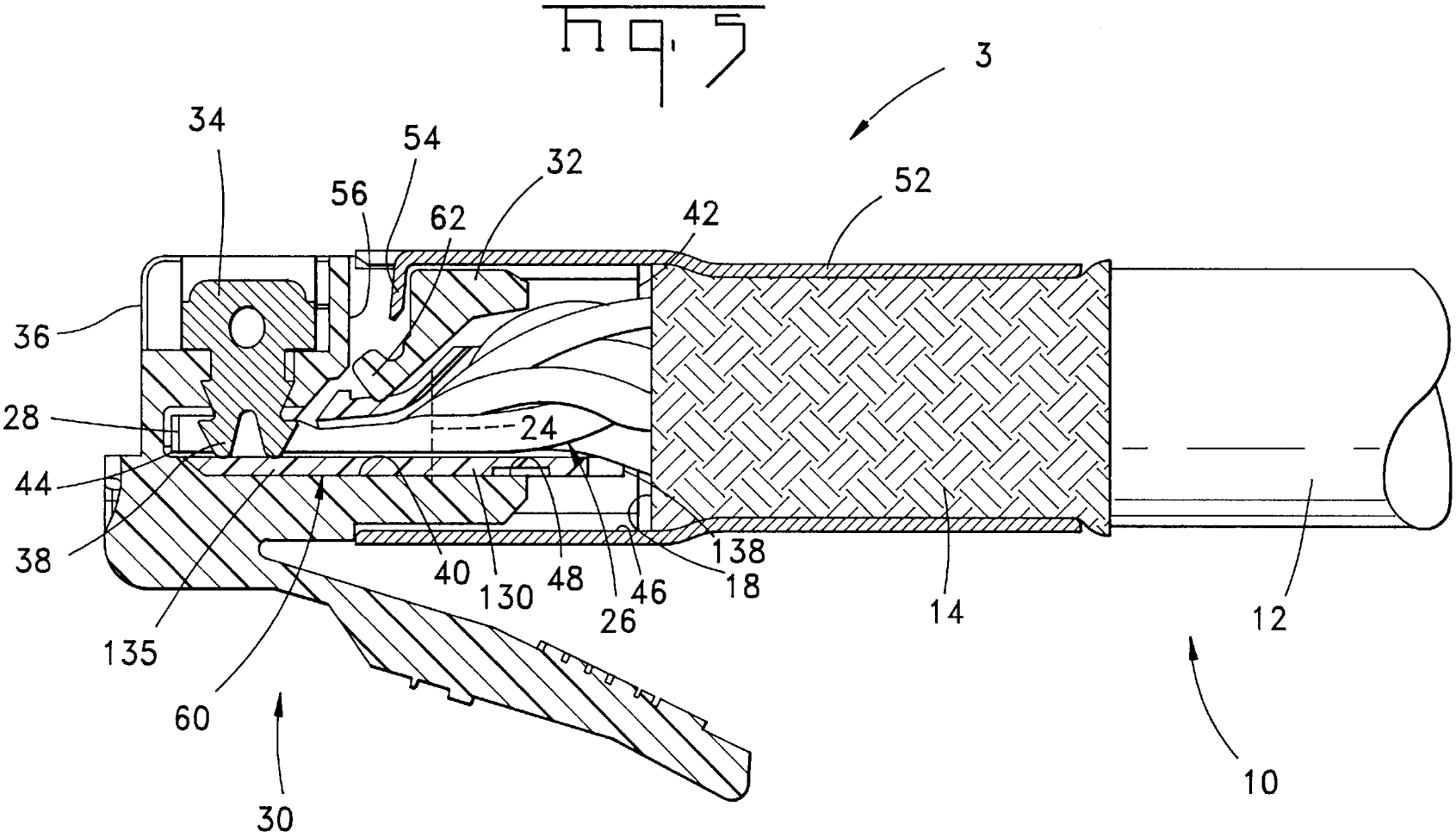
FIG. 5 is a cross sectional view of a cable and connector assembly according to this invention where the connector comprises a wire holder.

Referring to FIG. 1*a*, a cable 10 comprises an outer jacket 12 and a plurality of conductors 1 to 8 that are grouped in twisted pairs a to d. Conductors 1 and 2 form a twisted pair A, conductors 3 and 6 a twisted pair B, conductors 4 and 5 a twisted pair C, and conductors 7 and 8 a twisted pair D. Each conductor has an outer insulating layer and an inner conducting core. The outer jacket 12 comprises an outer insulating layer surrounding an inner shielding layer which is depicted in FIG. 5 as layer 14, that is folded back over the outside of the insulating layer.

In FIG. 1*a*, an end region 16 of the conductors 1 to 8 is exposed, extending from an end 18 of the cable jacket 12 to free ends 20 of the conductors.

Figure 1B:
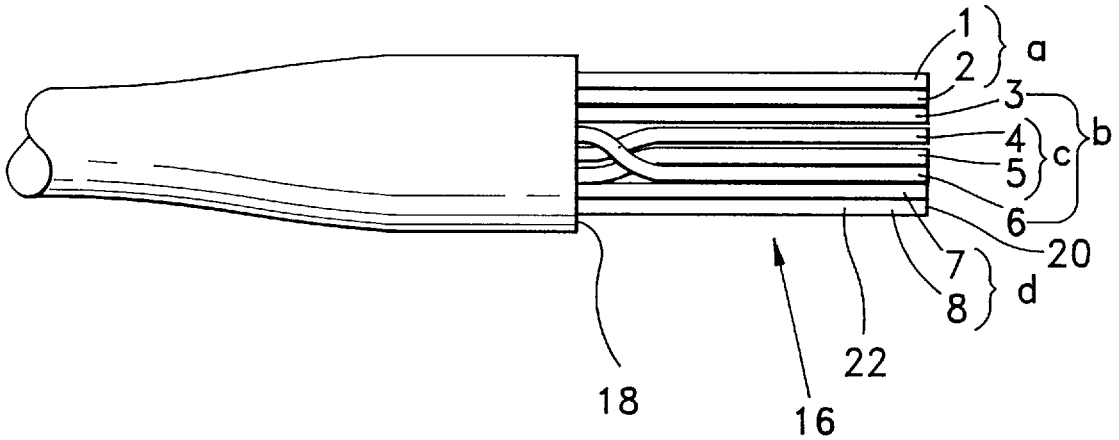
(PRIOR ART) Fig. 1b

Referring to FIG. 1*b*, the end regions 16 of the conductors 1 to 8 are untwisted and positioned in a juxtaposed substantially straight manner from the jacket end 18 to the free ends 20. End portions 22 of the end region 16 of conductors 1 through 8 are arranged in a juxtaposed, parallel manner one adjacent to the other in a successive order 1,2,3,4,5,6,7, and 8. This conductor arrangement is a typical industry standard, whereby the conductor pair B composed of conductors 3 and 6 are separated from each other such that conductor 6 has to cross over conductors 4 and 5 to achieve the order of the conductors 1 to 8 as shown in FIG. 1*b*. Due to the long, untwisted straightened portions of the conductor end regions positioned adjacent each other, cross-talk between pairs B and C, B and A, and B and D becomes excessive at high signal transmission speeds (for example what is known in the industry as category 5).

The level of cross-talk is largely influenced by the distance between adjacent conductors. This is because the degree of capacitive and inductive coupling between adjacent conductors, decreases roughly with the square of the distance separating the conductors. The degree of capacitive and inductive coupling between conductors is also strongly influenced by the distance, or lengths along which such conductors are positioned alongside each other.

Long, parallel sections of conductor end regions 16 as shown in FIG. 1*b*, therefore leads to high levels of cross-talk, and therefore limits signal transmission speed.

The present invention as will be described by way of example with the FIGS. 2 to 8, seeks to overcome the above mentioned problems by reducing the length of untwisted juxtaposed end portions of conductors, and separates where possible conductor pairs, thereby reducing the capacitive and inductive coupling between the pairs most effected by cross-talk.

Referring to FIGS. 1*a* and 2*a* to 2*e*, preparation of the cable prior to termination will now be described.

Firstly, a certain length of outer jacket 12 is removed to expose end regions 16 of the twisted pairs A to D, for example as shown in FIG. 1*a*.

Figure 2A:
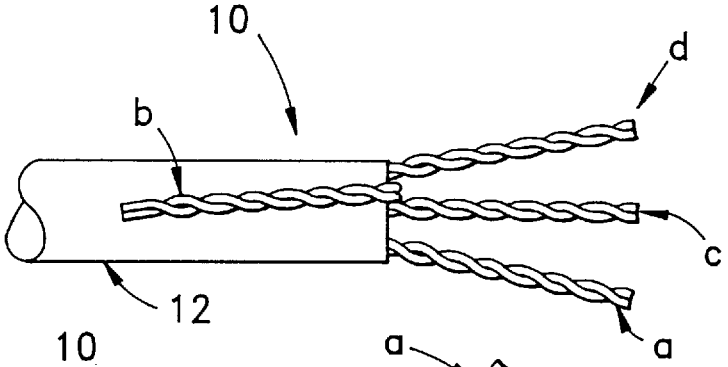
FIGS. 2*a*, 2*b*, 2*c*, 2*d* and 2*e* show successive steps in the preparation of a cable with twisted pair conductors for termination to a connector according to this invention.
Figure 2B:
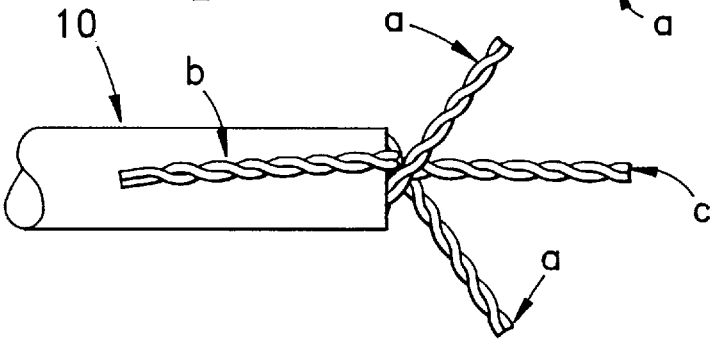
Figure 2C:
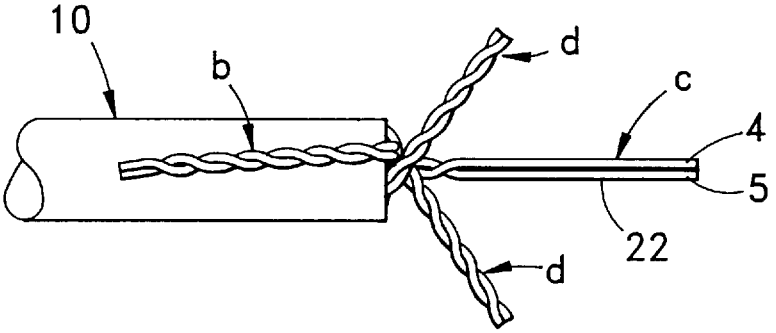

Referring to FIG. 2*a*, conductor pair B is bent out of the way of the other conductor pairs, and for more clarity conductor pair B is shown folded over the cable jacket 12. Conductor pair D is then pulled across over conductor pair C and conductor pair A is pulled over across D and C to give the configuration shown in FIG. 2*b*. The latter operation is similar to making a braid with three cords. End portions 22 of conductors 4 and 5 are then untwisted and positioned in a parallel juxtaposed manner in their order for termination as shown in FIG. 2*c*.

Figure 2D:
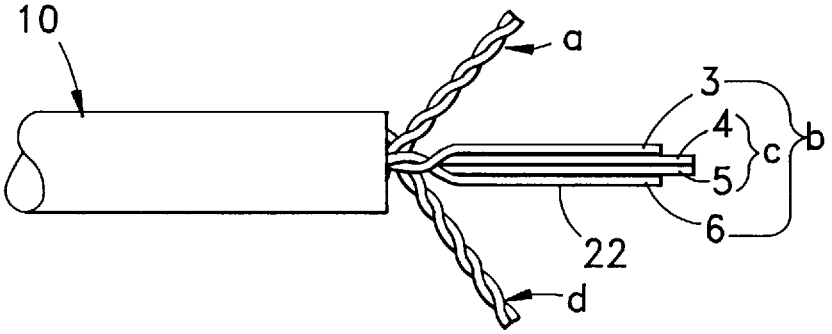
Figure 2E:
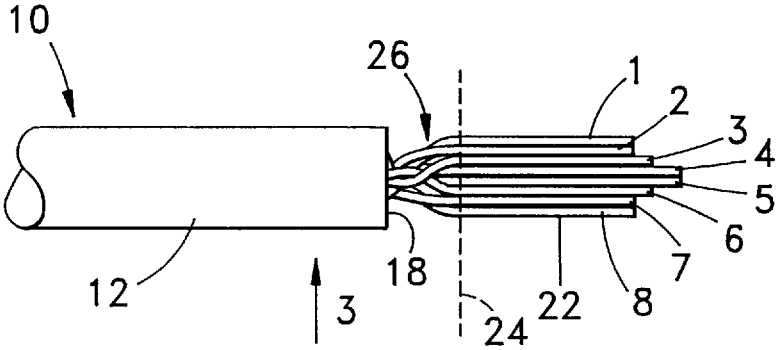

Conductor pair B is then folded over conductor pairs A and D, whereby an end portion 22 of conductor pair B is untwisted and conductors 3 and 6 positioned parallel and adjacent conductors 4 and 5 respectively, as shown in FIG. 2*d*. The outer conductor pairs A and D are then folded towards the other conductor pairs, whereby end portions 22 are untwisted and laid parallel and alongside conductor pairs B and C as shown in FIG. 2*e*, all the conductors in their respective positions for termination to a connector.

The dotted line 24 in FIG. 2*e* (hereinafter the "untwist line") indicates the approximate position after which all of the conductors 1 to 8 start extending in a parallel juxtaposed relationship. In the cable exit region 26 between the untwist line 24 which marks the beginning of the termination or end portion 22 of the conductors, and the end 18 of the jacket 12, the conductor pairs are in a substantially twisted mode. Furthermore, because of the braiding of conductor pair B over conductor pairs A and D (as illustrated in FIGS. 2*c* and 2*d*) the conductor pair B is separated by conductor pairs A and D from conductor pair C in the cable exit region 26.

Similarly, conductor pair B is separated by conductor D from conductor pair A in the exit region 26. Due to the braiding of conductor pairs A,D and B, they are all mutually crossed over, in other words transverse to each other such that capacitive and inductive coupling therebetween is minimal. In other words, two conductors that cross over each other at an angle are coupled capacitively and inductively to a lesser extent than if the conductors run parallel alongside each other. The separation between conductor pair C and B in the exit region 26 can also be clearly seen in FIG. 3.

Figure 6:
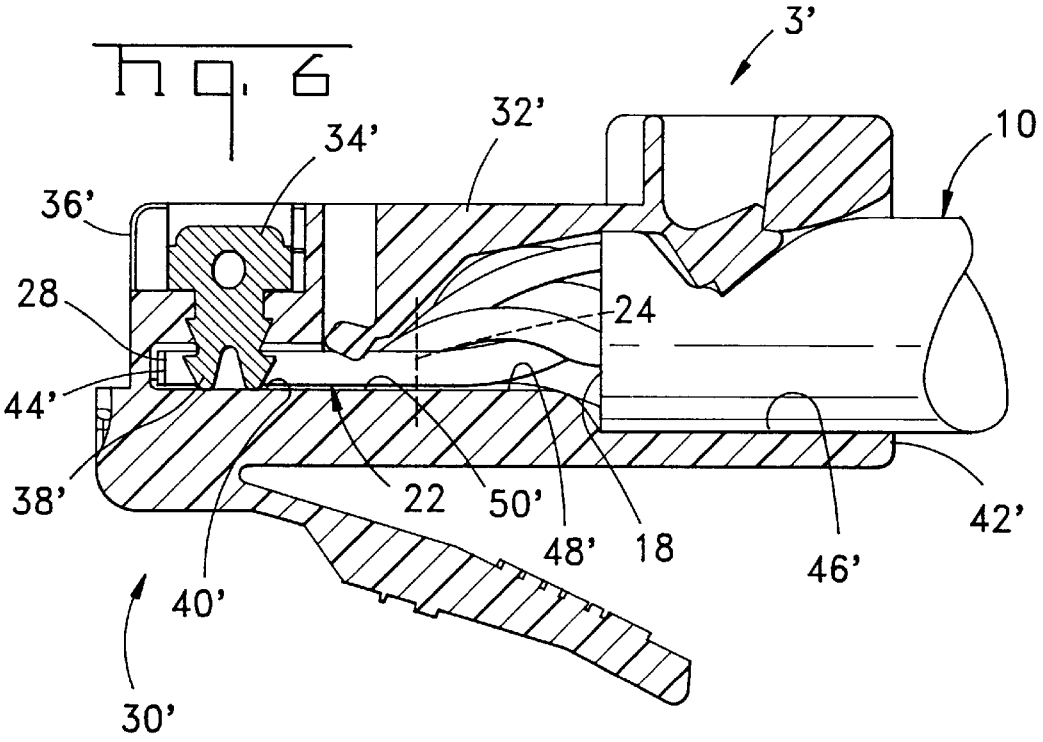
FIG. 6 is a cross sectional view through another cable and connector assembly embodiment without wire holder.

A shown in FIG. 4, the ends 20 of the conductors 1 to 8 are not all along the same line. These ends can then be trimmed along a line 28 that forms the new free ends of the conductors 1 to 8. The distance between the untwist line 24 and the trimmed free ends 28 is just sufficient for termination with contacts of a connector 30' as shown in FIG. 6. Connector 30' is similar to widely used plug connectors commonly called modular plugs, the connector comprising an insulative housing 32', a plurality of contacts 34' mounted in a juxtapose manner at a mating end 36' of the housing 32', the contacts comprising insulation piercing connection ends 38' that are insertable into a conductor receiving cavity 40' extending through the housing from a cable receiving end 42 to a mating or forward end 44'. The cavity 40' comprises a large entry portion 46' for receiving the cable outer jacket therein, the cavity extending into a funnel portion 48' that receives the cable exit region 26 of the prepared cable, the cavity further extending into channels 50' receiving the end portions 22 of the conductors 1 to 8. The contact insulation piercing connection ends 38' can be inserted into the channels 50' for piercing into the conductors for electrical connection thereto. The connector 30' and cable 10 assemble together to form a connector and cable assembly 3'. The braiding of the conductor pairs in the exit region 26 of the cable thus ensures low cross-talk in this region, due to the effects of crossing over of wires, maintenance of the twist, and spacing apart of conductor pairs as already described here above. The end portion 22 of the conductors that are juxtaposed and parallel for termination to the contacts 34' are as short as possible thereby reducing cross-talk.

Furthermore, the braiding operation is a simple repeatable procedure with defined assembly steps. The latter ensures consistent results and therefore a reliable cable and connector assembly for high speed data transmission, even if assembly is terminated in the field by human operators.

Referring now to FIG. 5, another embodiment of a cable and connector assembly 3 is shown, comprising the cable 10 and a connector 30 having many similar features to the connector 30' of FIG. 6. These similar features are denoted with the same numbering, but without a prime, and will not be re-explained in any detail except to point out the main differences between this embodiment and the embodiment of FIG. 6.

Figure 7:
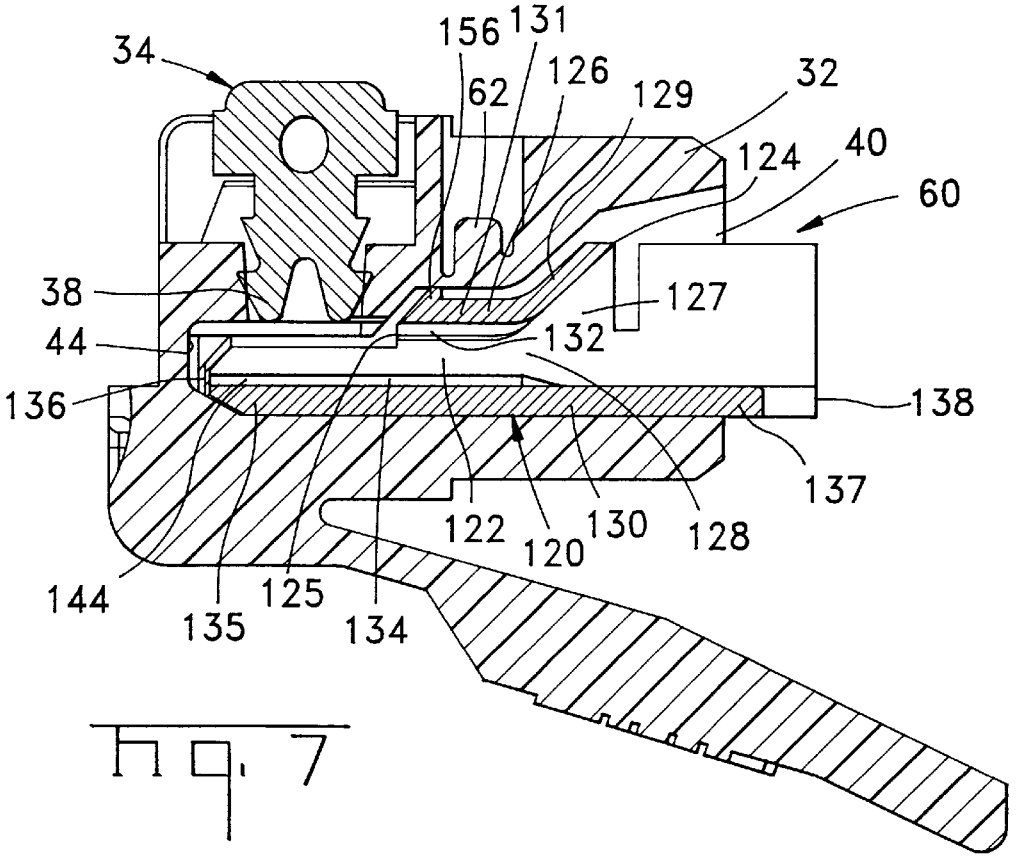
FIG. 7 is a cross sectional view through a connector according to the embodiment of FIG. 5.
Figure 8:
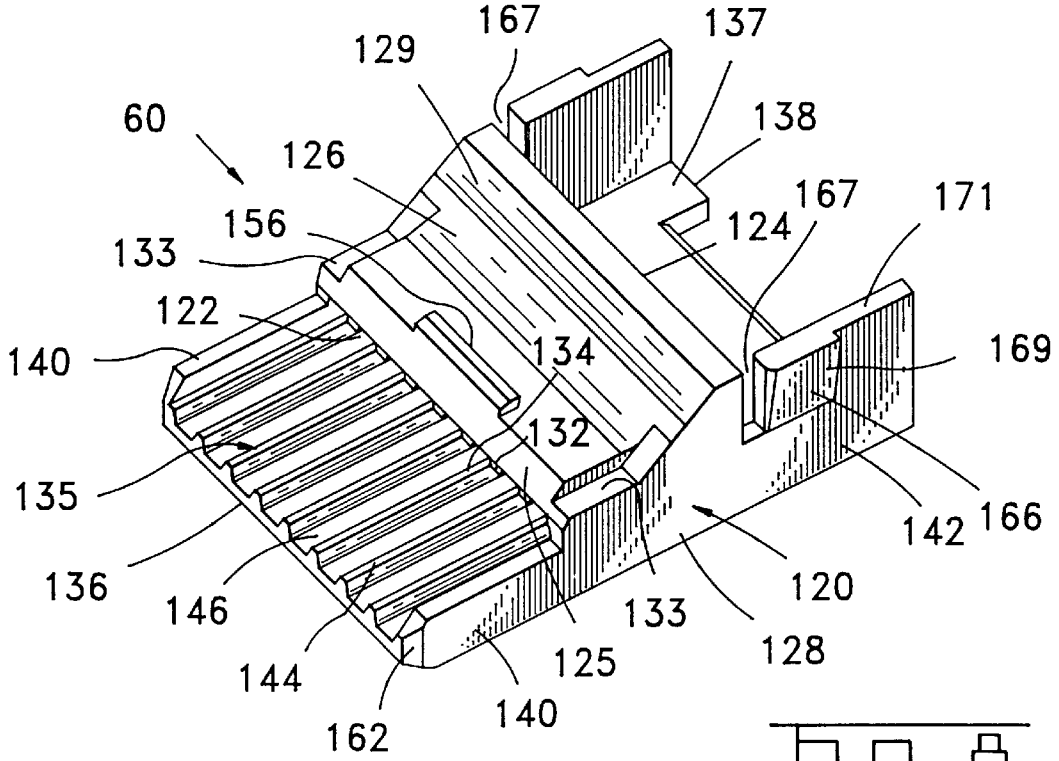
FIG. 8 is an isometric view of a wire holder of the connector embodiment of FIGS. 5 and 7.

The assembly of FIG. 5 comprises a conductive shield member 52 that is crimped around the shielding layer 14 of the cable 10 which is reversely folded over the exit end 18 of the jacket 12. The shield member 52 further extends over the cable receiving end 42 of the housing 32 and has a tab 54 bent into a recess 56 of the housing for securing the shield to the housing. The shield 52 can for example be an integral part either deep drawn or stamped and formed from sheet metal, and completely surrounding the periphery of the cable and cable receiving end of the housing to prevent electromagnetic noise from being emitted or received by the assembly. Another difference between the embodiment 30 from the embodiment 30' is the provision of a wire manager or holder 60 that is inserted into the cable receiving cavity 40 of the modular plug housing 32. Referring to FIGS. 5,7 and 8, the wire holder will be described in more detail.

The wire holder 60 comprises a wire receiving housing 120 having wire receiving areas 122 extending therethrough from a wire receiving end 124 to a contact end 125, the housing 120 comprising a top wall 126, side walls 128, and a base wall 130. Adjacent areas 122 are interconnected, whereby wall protrusions 132,134 protruding towards each other from the top and base walls 126,130 respectively are separated by a gap. The wall protrusions 132,134 define the wire receiving areas 122 for positioning and holding the wires in juxtaposed alignment.

The top wall 126 has a horizontal portion (parallel to the base 130) 125 and extending rearwardly therefrom to the wire receiving end 124, an outwardly oblique portion 129, that forms with the base wall 130 a funnel shaped wire entry portion 127. The wire entry portion 127 helps to guide the ends of the wire conductors into the wire receiving areas 122, and furthermore rigidifies the top wall to enable secure wedging of the cable exit section 26 therein (see FIGS. 5).

The base wall 130 has a forward extension 135 (see FIGS. 7) which extends from the contact end 125 of the housing 120 to a trimming end 136, the base wall having a further rearward extension 137 extending from the wire receiving end 124 of the housing 120 rearwardly to a cable end 138. There are also side wall extensions 140 (see FIGS. 8) extending from the contact end 125 of the side walls 128.up to the trimming end 136. There are further side wall extensions 142 extending from the wire receiving end 124 of the side walls 128 rearwardly towards the cable end 138. The front base wall extension 135 comprises wall protrusions 144 (see FIGS. 7 and 8) that are extensions of the base wall protrusions 134 for defining wire receiving grooves 146. The base forward extension 135 is positionable below insulation piercing tips 38 of the contacts 34 (see FIGS. 7). In the fully inserted position the top wall 126 of the housing 120 is positioned below a strain relief member 62 of the housing 32.

Assembly of the modular plug 30 to the cable 10 will now be described. Firstly, the cable is prepared as previously described with reference to FIGS. 2*a*–2*e*, 3 and 4, The length of cable exit section 26 should be slightly greater than the rear base wall extension 138 of the wire holder. The straightened conductor end portion 22 are then inserted into the corresponding cavity areas 122 of the wire holder, where the wire ends are sufficiently long to project beyond the front trimming end 136 such that they can be grasped and the wire holder pulled tightly towards the cable until all slack in the straightened cable ends is taken up and the rear end 124 of the wire holder housing 20 abuts the twisted pairs. Further pulling of the straightened cable ends through the cavity areas 122 tightens the twist of the twisted pairs in the cable exit region 26, and wedges them securely in the funnel shaped wire entry portion 127. The portions of the wire ends extending beyond the front end 136 can then be trimmed (i.e. at the trimming line 28 shown in FIG. 4), the front trimming end 136 of the base wall extension 135 serving as a reference for trimming. The assembled wire holder 60 and cable can thus be inserted into the cavity 40 of the modular plug until full insertion where the contact insulation piercing tips 38 are positioned above the conductor end portions 22. The contacts 34 can then be depressed as shown in FIG. 5 such that they pierce through the insulation of the conducting wires and make contact with the inner conducting strands.

Figure 9:
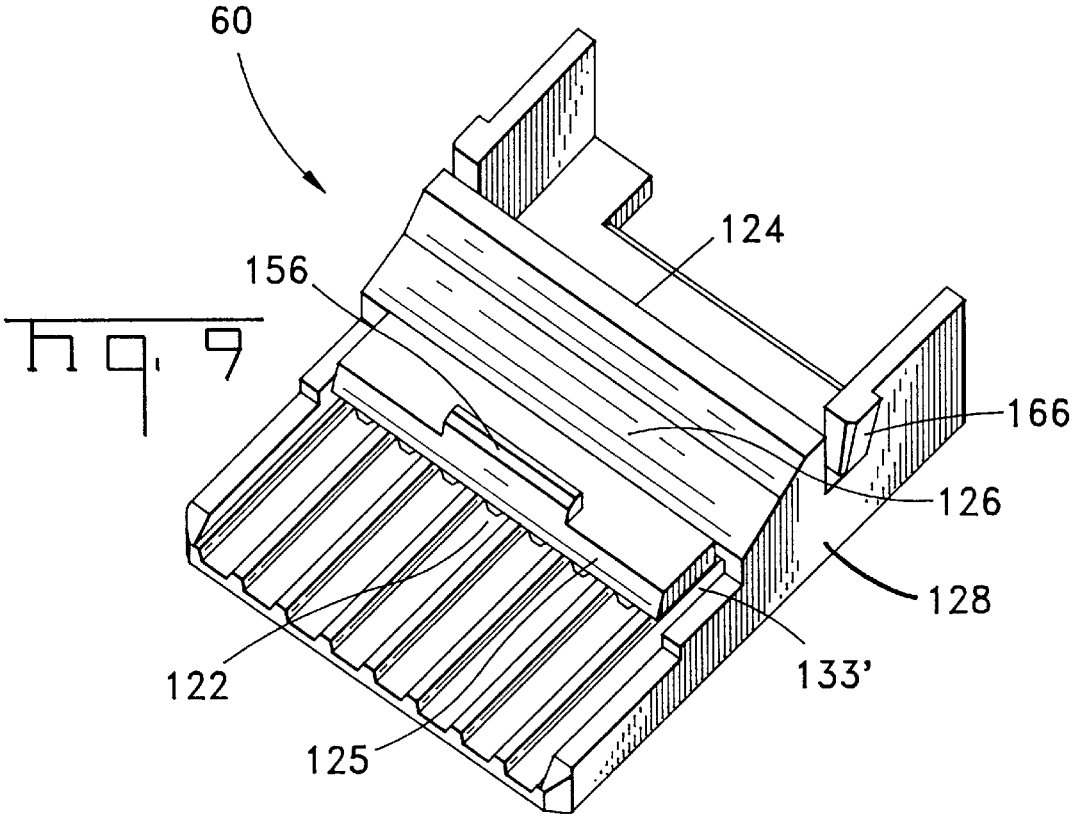
FIG. 9 is a view similar to that of FIG. 8 of a slightly different embodiment of a wire holder.

The strain relief member 62 is then depressed against the horizontal portion 131 of the top wall of the wire holder, which is sufficiently flexible in this region to clamp down on the wires in the cavity areas 122, thus gripping both the wire holder and wires in the plug housing 32. Flexibility can be increased by providing a reduced thickness at the attachment corner 133 joining the horizontal portion 131 to the side wall 128. The reduced thickness may also allow the top wall to shear breakthrough at the corners such that the wires are securely clamped by the top wall horizontal portion 131. Another option to the latter is to provide a slot 133' in the corner with the top wall 126 as shown in the embodiment of FIG. 9. The top wall 126 at the contact end 125 is thus flexible and can also be designed to resiliently clasp wire ends inserted in the cavity areas 122 during preparation of the assembly. This would assist trimming the wire ends and insertion of the wire holder in the modular plug housing 32.

The wire holder 60 further comprises a latching protrusion 156 positioned on the top wall 126 at the contact end 125, the protrusion being substantially centrally placed between the side walls 128. The latching protrusion ensures secure retention of the wire holder in the housing 32 when the strain relief member 62 is engaged. The wire holder further comprises centering chamfers 162 (see FIGS. 8) at the corner of the trimming end 136 and side walls 128, the chamfers cooperating with corresponding oblique surfaces of the modular plug housing 32 (not shown). The oblique surfaces abut each other once the wire holder has been fully inserted into the cavity 40 of the modular plug housing. The wire holder further comprises protrusions 166 (see FIGS. 8) extending from the side walls 128 and positioned proximate the wire receiving end 124. These protrusions 166 extend further outwardly than the width of the wire holder receiving cavity 40 such that there is an interference fit between the side wall protrusions 166 and side walls of the cavity 40. Resiliency of the protrusions 166 can be increased as shown in FIG. 8 by provision of the vertical slot 167 that separates the side wall rear end 142 partially from the housing side wall 128. The side walls 28 have a certain resiliency thus allowing elastic inward biasing of the protrusion 166 when the wire holder 310 is inserted into the cavity 40. Due to the positioning of the protrusion 166 proximate a wire receiving end of the wire holder, the trimming end 136 is able to pivot slightly, whereby the cooperation of the front oblique surfaces 62 of the holder and housing provide a means of centering the wire receiving grooves 136 accurately with respect to the modular plug housing, and therefore with respect to the contacts 34. The protrusions 166 can be provided, as shown in FIG. 8, with tapered side surfaces 169. The taper is such that the protrusion is the thickest at the top 171 of the wire holder, such that inward biasing of the sidewalls 142 pivots the protrusions to such a degree that the tapered side surfaces 169 lie flat against the modular plug cavity side walls. The latter ensures effective frictional grip of the wire holder in the cavity, to assist assembly.

Accurate positioning, and full insertion of the wire ends for connection to the contacts is thus ensured, thereby enabling provision of the shortest possible straightened lengths of wire ends, and a reliable connection thereto. The use of a wire holder combines advantageously with the braided preparation of the cable to ensure a tight braiding of the cable exit end section and as short a straightened length as possible whilst further benefitting from the cross-over and spacial separation effects of the braid discussed here and above. Provision of a funnel shaped on the wire holder is also advantageous in that it not only helps to guide the wires through the wire holder, but also rigidifies the top wall and additionally wedges the twisted wire portions. Such a feature would of course be advantageous without the braided cable, but also if the conductor pairs were simply twisted in order to maintain their twist as close to the contacts of the connector as possible. The resiliently biasable protrusions on the side walls that help to center and position the wire holder within the plug housing cavity assists in providing precise alignment of the conductors with the connector contacts.

We claim:

1. An assembly comprising a modular plug and a cable having pairs of twisted wires for connection thereto, the plug comprising a housing, contacts for connection to end portions of the wires, and a wire holder receivable in a cavity of the housing, the wire holder comprising an integral housing having a base wall, top wall, side walls and wire receiving areas extending therethrough from a wire receiving face to a contact end face, characterized in that the top wall comprises an outwardly oblique portion extending from the wire receiving face forming a funnel shaped wire entry portion, wherein the pairs of twisted wires are in a twisted pair configuration up to the wire receiving face of the holder.

2. The assembly of claim 1 wherein the wire holder comprises a base extension positionable below the contacts within the housing cavity for positioning the wire end portions of the cable extending along the base extension below the contacts for connection thereto.

3. The assembly of claim 2 wherein the base extension extends from the base wall and comprises grooves for positioning the wire ends thereon.

4. The assembly of claim 3 wherein the base extension has a forward trimming end that serves as a reference for trimming the wire ends such that they are all positionable proximate a forward end of the plug housing cavity.

5. The assembly of claim 1 wherein the wire holder comprises a rearward base extension extending from the holder housing in an opposing direction to the forward base extension.

6. The assembly of claim 1 wherein the wire holder has centering surfaces cooperable with complementary centering surfaces of the plug housing, for accurate lateral positioning of the base extension with respect to the housing.

7. The assembly of claim 6 wherein the centering surfaces comprise tapered surfaces on the side walls proximate the forward trimming end, cooperable with complementary oblique surfaces in the wire holder receiving cavity of the plug housing.

8. The assembly of claim 7 wherein the centering surfaces comprise protrusions extending outward from the wire holder side walls, positioned proximate a wire receiving end thereof, and cooperable in an interference fit with side walls of the wire holder receiving cavity of the plug housing.

9. The assembly of claim 1 wherein the cable has an outer jacket surrounding the pairs of twisted wires which have an end region extending beyond an end of the jacket, whereby the twisted pairs of wires are braided such that one pair is separated from a second pair by at least a third pair proximate the end of the cable jacket.

10. The assembly of claim 1 wherein the top wall, bottom wall, and side walls surrounding the wire receiving areas, a portion of the top wall proximate the contact end face having weakened portions or slots at corners with the side walls.

* * * * *